United States Patent [19]

Tisdale

[11] 4,317,517

[45] Mar. 2, 1982

[54] LAMINATED PAPER LOAD SPACER AND SUPPORT

[75] Inventor: Lucien E. Tisdale, Monroe, La.

[73] Assignee: Fiber Tech, Inc., Monroe, La.

[21] Appl. No.: 119,827

[22] Filed: Feb. 8, 1980

[51] Int. Cl.[3] ..... B65D 19/00

[52] U.S. Cl. ..... 206/597; 206/599; 206/586; 206/587

[58] Field of Search ..... 428/166, 188, 72, 35, 428/36; 206/597, 599, 585, 586, 587, 591, 594

[56] References Cited

U.S. PATENT DOCUMENTS

| | | | |
|---|---|---|---|
| 1,922,560 | 8/1933 | Sullivan | 206/397 |
| 2,052,605 | 9/1936 | Clark et al. | 428/72 |
| 2,446,914 | 8/1948 | Hallert et al. | 206/599 |
| 2,831,688 | 4/1958 | Knox | 428/72 |
| 2,896,207 | 7/1959 | Wilson | 206/599 |
| 3,331,496 | 7/1967 | Marsden et al. | 206/597 |
| 3,444,034 | 5/1969 | Hewett | 428/72 |
| 4,050,664 | 9/1977 | Daley | 108/56.3 |

*Primary Examiner*—Joseph Man-Fu Moy
*Attorney, Agent, or Firm*—Harvey B. Jacobson

[57] ABSTRACT

A load spacer or support constructed of laminated paper and adhesive material to form a generally "W" shape load spacer or support having a full depth slot throughout the length thereof to accept a tie strap and two trapezoidal shaped hollow load cells defining the slot with the load cells being interconnected by a top sheet or panel having depending flanges along each side edge thereof overlapping and secured to the outer surfaces of the load cells which provides a tension force in a horizontal plane to counteract deformation of the cells under compression. The load spacer, support or batten may be employed in various orientations with respect to stacks of flat sheets of material, such as wall board, panelling, particle board, and the like, and replaces conventional employed solid wood pieces, such as a 2"×4" wood member having a slot milled into one surface thereof to accommodate the tie strap.

2 Claims, 6 Drawing Figures

LAMINATED PAPER LOAD SPACER AND SUPPORT

BACKGROUND OF THE INVENTION

1. Field of the Invention

The present invention generally relates to a load spacer or support of laminated paper used under, between or in other associations with various types of loads such as flat sheets of wallboard, panelling, particle board, or the like, provided in stacks or other load arrangements which includes a pair of hollow cells along each side thereof separated by a continuous slot and connected by a top panel or sheet having the side edges downturned and secured to the outer surfaces of the cells in which the cells are generally trapezoidal in configuration.

2. Disclosure of Relevant Art

U.S. Pat. No. 2,626,456, issued Jan. 27, 1955, to Harrison discloses a skid runner with a slot for receiving a strap in which the runner is adapted to be cast in lead and actually becomes part of the skid load of lead bars being transported. U.S. Pat. No. 2,716,532, issued Aug. 30, 1955, to Wysong, discloses a foldup corrugated board skid runner which is triangular in shape with the tie strap adapted to run inside the three-sided tube. U.S. Pat. No. 3,331,496, issued July 18, 1967, to Marsden, discloses a method of compressing a skid load of material prior to attaching wooden runners to the base and is apparently limited to use with very heavy loads such as metal sheets or other dense materials which are compressed to unify the load prior to strapping. U.S. Pat. No. 3,247,810, issued Apr. 26, 1966, to Sepe, discloses a mass produced strip of metal or plastic having nestable cones indented or formed in the material with lengths of this preformed strip being placed under a load for support and considerable difficulty of placement and securing the strips under the load would occur and there is no provision for securing the strap and disposal of this item could be troublesome. U.S. Pat. No. 4,050,664, issued Sept. 27, 1977, to Daley, discloses a generally rectangular paperboard tube with inserts of foam material incorporated therein for rigidity.

While the above mentioned patents disclose various structures in the form of load spacers, none of them disclose a load spacer or support which is lightweight, inexpensive, capable of substantially universal usage, easy to associate with a load in various orientations and easily receiving the tie strap, constructed of paperboard which is easily disposable and relies upon the unique shape of the material itself to provide the necessary structural and load bearing properties.

SUMMARY OF THE INVENTION

An object of the present invention is to provide a load spacer or support constructed of laminated paper board and conventional adhesives constructed with trapezoidal shaped components connected at the top and providing a slot for receiving a tie strap.

Another object of the invention is to provide a load spacer or support in accordance with the preceding object which enables it to be recycled along with other paper and corrugated waste material thereby reducing disposal problems of the spacer and support after it has been used.

A further object is to provide a load spacer and support in accordance with the preceding objects which can be constructed in endless form on a continuous machine so that unusually long lengths can be furnished for special packaging applications or any desired length can be provided.

Yet another object of the present invention is to provide a laminated paper spacer and support in accordance with the preceding objects which is relatively wide and flat thus rendering it practical to use two or more spacers or supports as runners strapped directly to the material being shipped thus forming a unitized load without the need for a pallet top of deck sheet.

Still another object of the invention is to provide a laminated paper load spacer or support in accordance with the preceding objects which can be treated with wax or other suitable impregnants to improve weathering properties.

Another important feature of the present invention is the provision of a laminated paper load spacer or support similar in shape to wood battens and which can be used to replace existing wood battens and is compatible with automatic strapping machines presently utilized in the packaging field and improving the operational characteristics of such machines by providing an item of uniform quality, not subject to warping or imprefections prevelant in rough wood which has a tendency to warp and split thus causing jams in the batten feeders, thereby resulting in downtime of the strapping equipment to correct the problem.

Still another important feature of the present invention is to provide a laminated paper load spacer and support in accordance with the preceding objects which is substantially "W" shaped and includes trapezoidal shaped load cells on each side of a full length slot which receives the tie strap together with a top member which connects the trapezoidal shaped cells together with the two part construction enabling the shape of the product to be defined and held after the product has been formed and also providing lateral resistance to deformation under load.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
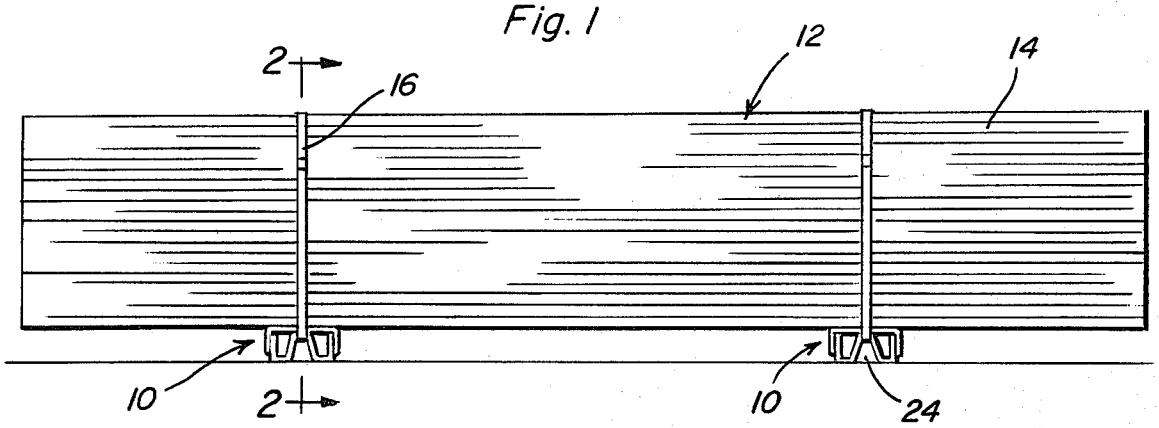
FIG. 1 is a side elevational view of a load consisting of a plurality of panels stacked on top of each other with a pair of the load spacers or supports positioned thereunder and secured thereto by tie straps.
Figure 2:
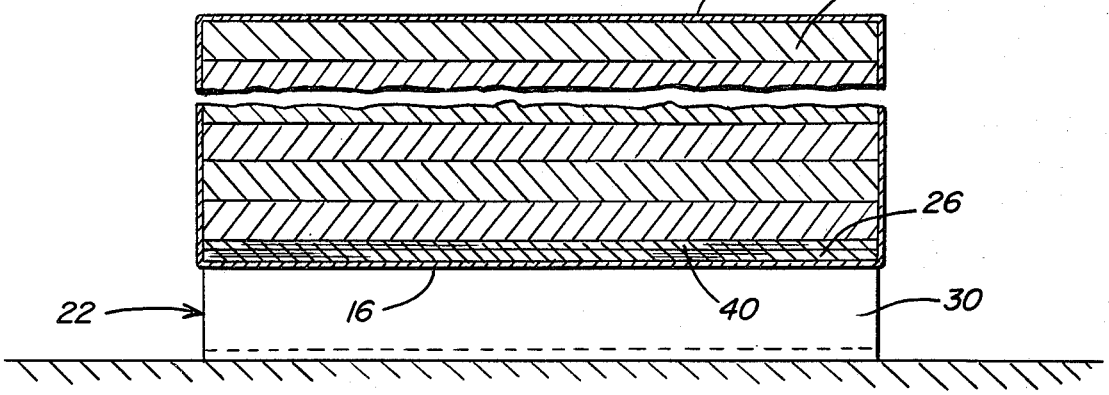
FIG. 2 is a transverse, sectional view taken substantially upon a plane passing along section line 2—2 of FIG. 1 illustrating further structural details of the load spacer or support and the relationship of the tie strap to the slot therein.

Referring now specifically to the drawings, the load spacer and support of the present invention is generally designated by reference numeral 10 with FIGS. 1 and 2 illustrating one typical use of a pair of the load spacers and supports 10 extending transversely under a load generally designated by the numeral 12 which may be in the form of a stack of flat sheets or panels 14 such as wall boards, panelling, particle board, or the like, with the load 12 and the load spacers and supports 10 being secured in assembled relation to provide a unitized load by conventional tie straps 16 which are assembled by the use of conventional and existing strapping equipment so that the load may be handled by conventional forklifts, and the like, without the use of a separate pallet.

Figure 3:
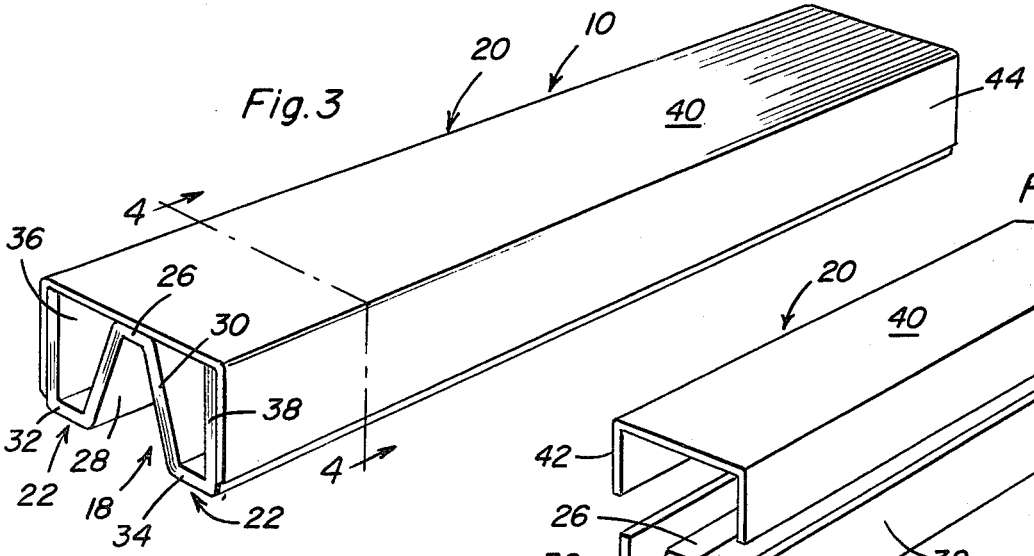
FIG. 3 is a perspective view of one of the load spacers or supports of the present invention.
Figure 5:
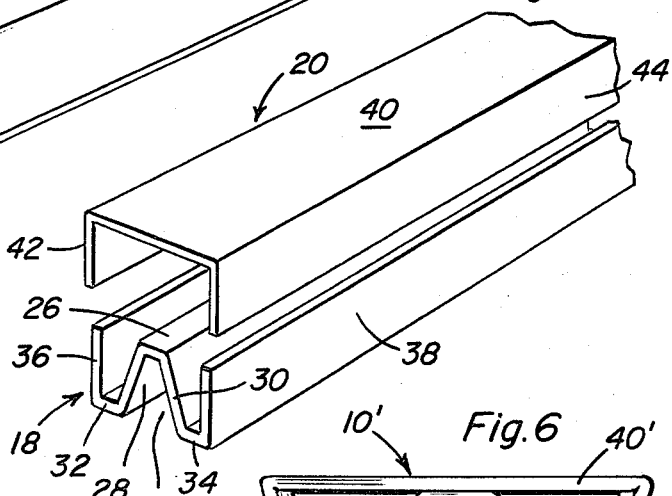
FIG. 5 is an exploded perspective view of the two components forming the load spacer or support.
Figure 4:
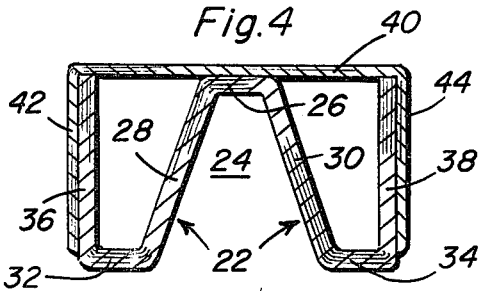
FIG. 4 is a transverse sectional view taken substantially upon a plane passing along section line 4—4 of FIG. 3 illustrating the structure and configuration of the load spacer or support.

The specific details of the load spacer and support 10 are illustrated in FIGS. 3–5 and includes two sections such as a base generally designated by numeral 18 and a top generally designated by the numeral 20. The base 18 and top 20 both are elongated and may be formed on a continuous length machine to enable the load spacer and support 10 to be of any desired length. Both the base 18 and the top 20 are constructed of laminated paper and adhesive and may be formed by using a method generally the same as in my prior U.S. Pat. No. 3,178,494 and other well-known converting methods such as scoring, laminating, folding, pressing, drying, and the like, will also be employed. Thus, the product is made on a continuous converting line where rolls of paper and adhesive would be combined to generate the shape of the base 18 and top 20 in endless length and the top and base components are joined to form the load spacer and support 10 in endless length.

The base 18 includes two trapezoidal shaped components or load cells 22 defining a continuous slot 24 throughout the length of the load spacer and support 10 for receiving the tie straps 16. The trapezoidal cells or components define a generally "W" shape with a central horizontal flange 26, a pair of downwardly diverging inner flanges 28 and 30 integral therewith with each of the flanges 28 and 30 including an outwardly extending, relatively short horizontal bottom flange 32 and 34. The outer edge of the bottom flange 32 is provided with an upstanding vertical side flange 36 and likewise, the bottom flange 34 is provided with a vertically upstanding side flange 38 at the outer edge thereof with the free upper edge of the side flanges 36 and 38 being generally coplanar with the upper surface of the center top flange 26, as illustrated in FIG. 4. The top 20 includes a top sheet or panel 40 and downturned side flanges 42 and 44 which overlap and are adhesively bonded to the outer surface of the vertical side flanges 36 and 38 of the base 18, as illustrated in FIG. 4.

Figure 6:
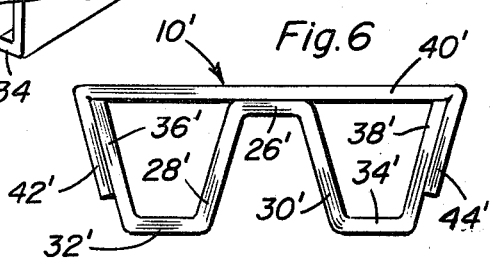
FIG. 6 is an end view of a slightly modified embodiment of the present invention.

FIG. 6 illustrates a modified form of the invention in which the vertical height of the load spacer and support 10' is less as compared to the horizontal width when comparing it with the structure illustrated in FIGS. 1–4. Also, in this embodiment, the outer side flanges 36' and 38' diverge upwardly and correspondingly, the flanges 42' and 44' converge downwardly but they still are secured to the external surface of the side flanges 36' and 38' by adhesive bonding.

While the shape and dimensional characteristics of the load spacer and support 10 or 10' may vary, in one typical structure, the vertical height of the structure illustrated in FIGS. 3–5 is $2\frac{1}{2}''$ while the width is 4-3/16", the width of the top flange 26 is $\frac{5}{8}''$ and the thickness of the components of the base 18 are 0.188", while the flanges 30 and 28 are inclined downwardly and outwardly 18° from vertical. In the arrangement illustrated in FIG. 6, the vertical height may be $1\frac{3}{4}''$, the horizontal width being $4\frac{1}{4}''$, the components of the base may be 0.150" thick and the top may be 0.075". As pointed out above, these dimensions may vary and the device may be constructed in various sizes, shapes and configurations of any requisite length as long as the trapezoidal areas 22 and the relationship between the base 18 and top 20 are maintained with both components being constructed of laminated paperboard.

The load spacer and support, being constructed of laminated paperboard, is lightweight and inexpensive and is capable of substantially universal usage as more clearly set forth hereinafter. In addition, the paperboard material reduces problems of disposal of the load spacer and support after it has been separated from the load, since it can be disposed of in the same manner as any paper product. The shape of the spacer and support provides the structural properties needed to support loads for shipping or to act as spacers between such loads. The hollow laminated board construction and the trapezoidal shaped components connected by the top and providing a slot for receiving the tie strap effectively performs the functions for which the device is intended. The two-part construction, that is, the base and the connecting top serves to hold and define the shape of the spacer and support after it has been formed and provides the lateral resistance to deformation under load necessary for the spacer and support to effectively perform its function.

As illustrated in FIG. 1, the top surface of the spacer and support 10, being relatively wide and flat, will make it practical to use two or more load spacers and supports 10 as runners strapped directly to the load 12 being shipped thus forming a unitized load without the need for a pallet top or deck sheet. When used as a spacer or "batten" between stacks of flat sheets of material, such as wall board, panelling, particle board, or the like, the spacer is inserted by an automatic feeder under the stack while a steel strap is tightened around the load generally in two or more places depending upon the length of the sheets. The panels are placed by means of a forklift truck or the like in layered stacks in a warehouse or freight car frequently resulting in loads on the bottom battens of 150 lbs. per linear inch or more. While wood battens, usually wood pieces with a slot milled in one side to accommodate the strap are used for this purpose, such wood battens, especially if green wood is used, tend to warp and split thus causing jams to occur in the batten feeders and resulting in downtime of the strapping equipment to correct the problem. The laminated paper spacer and load support of this invention eliminates this problem by providing a uniform quality and uniform size to the spacer and support and the full depth slot readily and easily accepts the tie strap and the trapezoidal shaped load cells on each side of the slot resist lateral forces which occur in shipping. The tendency of the "W" shape to spread under load is resisted by the top sheet with the side flanges secured to the trapezoidal cells thus providing a tension force in a horizontal plane to counteract deformation of the cells under compression.

Various other uses of the spacer and support will occur in association with various types of materials for shipping. For example, a pair of inverted load supports or spacers may be provided under that portion of the strap 16 which extends across the top of the load so that the load may be spaced from other loads or either side may be supported from a supporting surface. Likewise, vertically oriented spacers and supports may be provided under the strap 16 along the side edges of the load thus further protecting the panels and unitizing the load. Other types of loads such as cylindrical structures, and the like, may also be supported by the spacers and supports with various tie strap arrangements being employed.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A load support, spacer, batten or the like comprising an elongated continuous member constructed of laminated paperboard and adhesive to form a substantially rigid member, said member being generally of W-shape and including a pair of generally parallel, hollow load cells, each of said load cells being defined by an inner wall and an outer wall, a narrow wall connecting the outer edge portions of the inner and outer walls of each cell, a narrow wall connecting the inner edge portions of the inner walls of the pair of cells for stabilizing the load cells while leaving the space included between the outer portions of the inner walls of the pair of cells free of obstructions thereby defining a continuous laterally opening slot defined on three sides by the inner walls and the narrow wall connecting the inner edge portions of the inner walls with the fourth side being open and free of any connecting structure throughout its length, both said narrow walls being a continuation of the laminated paper board and adhesive of the sidewalls thereby forming a substantially rigid member of W-shape cross-sectional configuration and a continuous connecting panel overlying both of the load cells and being connected to the outer walls and the narrow wall connecting the inner edge portions of the inner wall.

2. The structure as defined in claim 1 wherein said inner walls of the pair of hollow load cells converge inwardly thereby defining trapezoidal load cells and laterally stabilizing the load cells, said narrow walls being generally parallel and the narrow walls connecting the outer edge portions of the inner and outer walls of each cell being in alignment to form two spaced parallel surfaces to engage an adjacent surface, said connecting panel including side flanges extending over and secured to a major portion of the external surface of the outer walls of the load cells.

* * * * *